US006584951B1

(12) United States Patent
Patel et al.

(10) Patent No.: US 6,584,951 B1
(45) Date of Patent: Jul. 1, 2003

(54) INDIVIDUAL HYDRAULIC CIRCUIT MODULES FOR ENGINE WITH HYDRAULICALLY-CONTROLLED CYLINDER DEACTIVATION

(75) Inventors: Vimesh M. Patel, Novi, MI (US); William Conrad Albertson, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/011,168

(22) Filed: Dec. 6, 2001

(51) Int. Cl.[7] ..... F01L 1/34
(52) U.S. Cl. ..... 123/198 F; 123/90.16
(58) Field of Search ..... 123/198 F, 90.16

(56) References Cited

U.S. PATENT DOCUMENTS 4,534,323 A * 8/1985 Kato et al. ..... 123/90.16
4,584,974 A * 4/1986 Aoyama et al. ..... 123/90.16
5,803,040 A * 9/1998 Biesinger et al. ..... 123/198 F
6,196,175 B1 3/2001 Church ..... 123/90.16
6,477,997 B1 * 11/2002 Wakeman ..... 123/90.16

* cited by examiner

*Primary Examiner*—Willis R. Wolfe
*Assistant Examiner*—Douglas A. Salser
(74) *Attorney, Agent, or Firm*—Leslie C. Hodges

(57) ABSTRACT

An internal combustion engine includes hydraulically-controlled cylinder deactivation and has an engine block with a plurality of cylinders formed therein. At least one-half of the cylinders are deactivatable by collapsible lifters. An individual hydraulic circuit module is positioned adjacent each deactivatable cylinder. Each hydraulic circuit module includes a valve and is configured to receive a supply of oil from the engine block and to selectively provide pressurized oil to the respective collapsible lifters for cylinder deactivation. A solid cover plate is positioned adjacent each cylinder which is not deactivatable.

13 Claims, 5 Drawing Sheets

Fig. 1
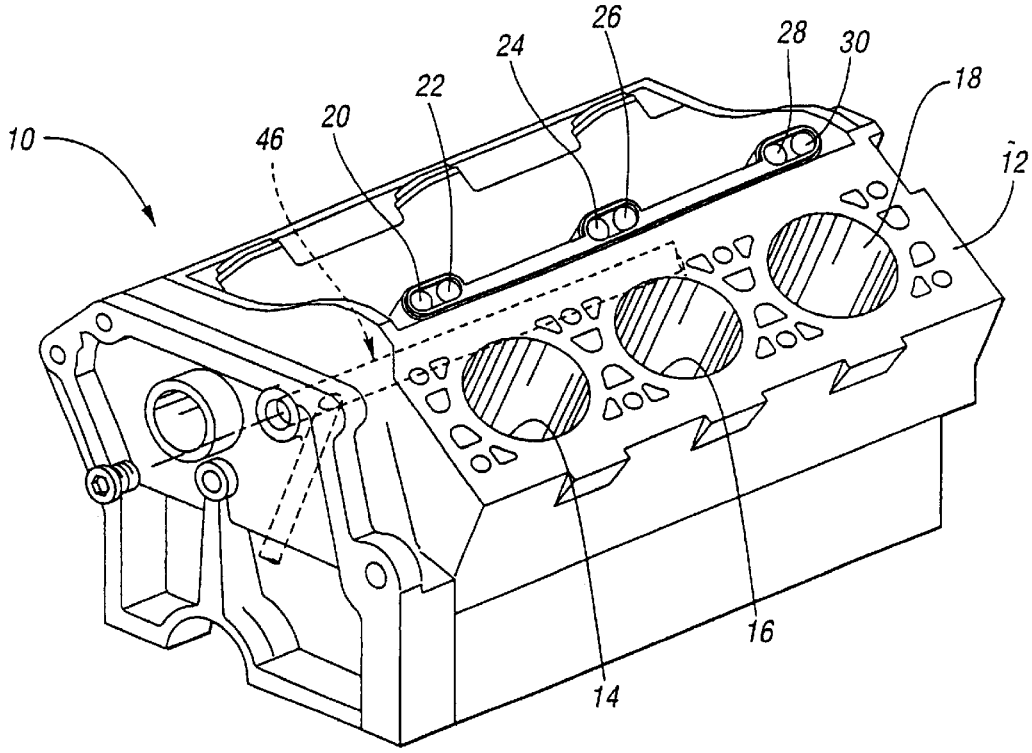
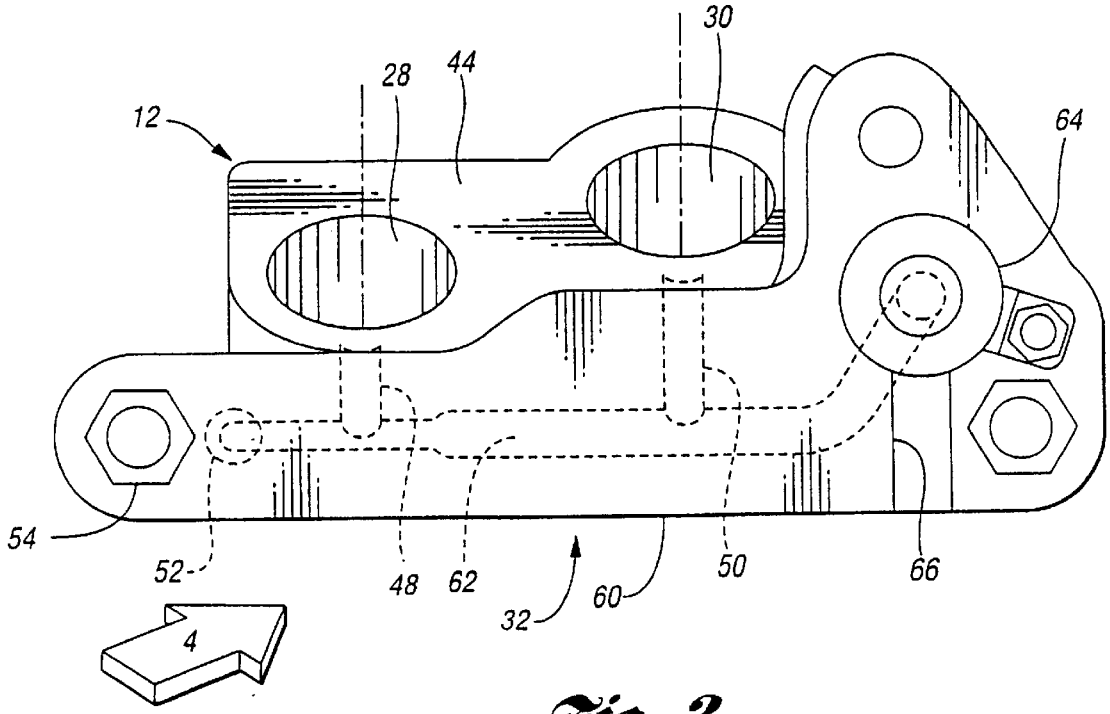
Fig. 3

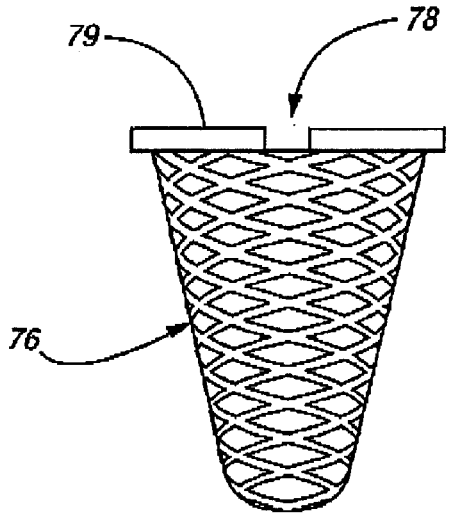
Fig. 6
Fig. 7
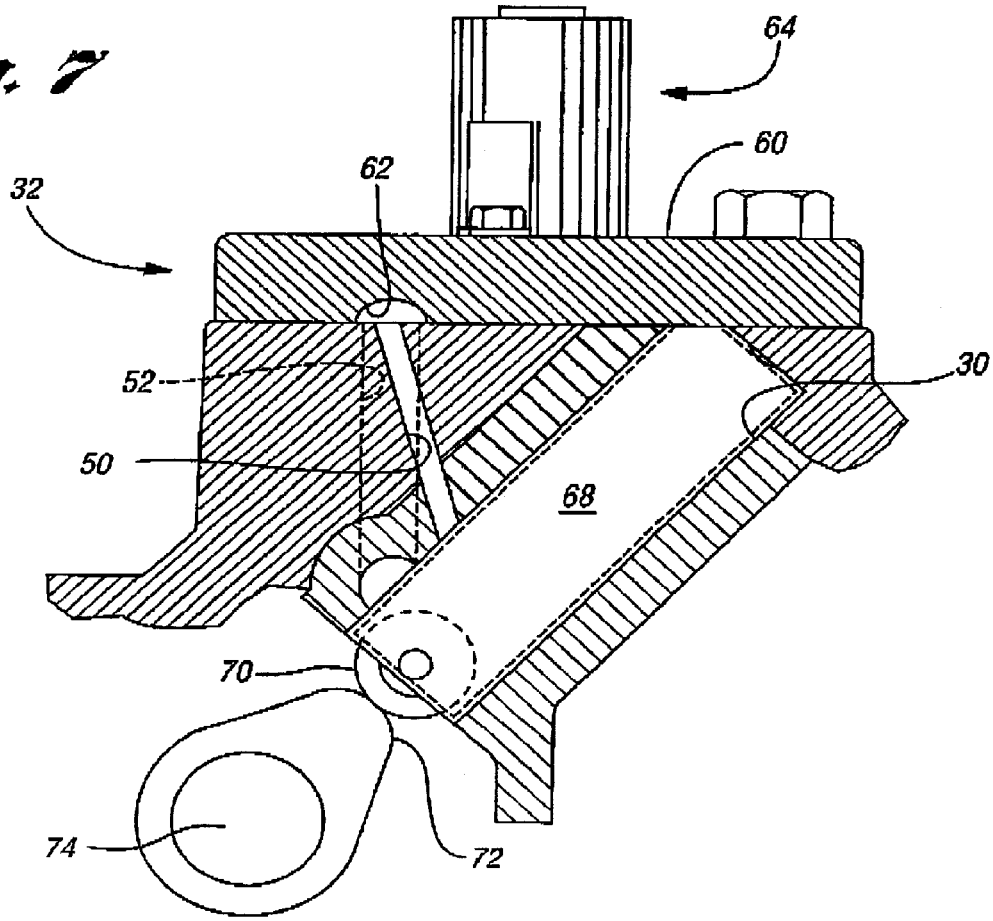

INDIVIDUAL HYDRAULIC CIRCUIT MODULES FOR ENGINE WITH HYDRAULICALLY-CONTROLLED CYLINDER DEACTIVATION

TECHNICAL FIELD

The present invention relates to an internal combustion engine having individual hydraulic circuit modules for hydraulically controlling cylinder deactivation in individual cylinders of the engine.

BACKGROUND OF THE INVENTION

Valve deactivation is used for improving fuel efficiency in engines. Valve deactivation cuts off one-half of the available cylinders by deactivating valve lift in those cylinders so that such cylinders remain closed after a combustion cycle of the engine, and the burnt gases remain trapped within the cylinder during deactivation.

Some valve deactivators are used in internal combustion engines having a push rod type valve gear train in which there is a rocker arm, with one end of the rocker arm engaging a push rod, and the other end engaging the engine poppet valve. Typically, a central portion of the rocker arm is fixed relative to the cylinder head by a fulcrum arrangement in which the fulcrum normally prevents movement of the central portion of the rocker arm in an "up and down" direction. At the same time, the fulcrum permits the rocker arm to engage in cyclical, pivotal movement, in response to the cyclical motion of the push rod, which results from the engagement of the push rod with the lobes of the rotating camshaft.

There are a number of known valve deactivator assemblies which are operably associated with the fulcrum portion of the rocker arm and which, in the latched condition, restrain the fulcrum portion of the rocker arm to move in its normal cyclical, pivotal movement. However, in an unlatched condition, the valve deactivator assembly permits the fulcrum portion of the rocker arm to engage in "lost motion" such that the cyclical, pivotal movement of the push rod causes the rocker arm to undergo cyclical, pivotal movement about the end which is in engagement with the engine poppet valve. In other words, the rocker arm merely pivots, but the engine poppet valve does not move, and therefore is in its deactivated condition.

U.S. Pat. No. 6,196,175 discloses a valve deactivator which is incorporated into a cam follower assembly, and is hydraulically actuated. This device includes an outer body member which engages and follows the cam, and an inner body member disposed within the outer body member and reciprocable relative thereto. The inner body member includes means for transmitting the cyclical motion of the cam to the remainder of the valve gear means when the outer and inner body members are in a latched condition. A latch assembly is positioned within the inner body member when in the unlatched condition, and includes a radially movable latch member. A source of pressurized fluid, such as oil, is operatively associated with the latch assembly, and is operative to bias the latch member toward the unlatched condition.

A hydraulically-actuated valve deactivator, such as that described in the '175 patent, requires pressurized oil for operation. A hydraulically-controlled cylinder deactivation system typically uses this pressurized oil to control the switching member of the system in a manner to deactivate cylinders through lost motion of the inlet and exhaust valves.

A single custom module is generally provided to receive the pressurized oil from an engine and to provide the hydraulic supply, exhaust and control of the oil which is needed to operate the switching member (such as the valve deactivator of the '175 patent) for all deactivatable cylinders.

In the single custom module, the system of channels used to supply the hydraulic oil to all of the switching members can be complex and difficult to package within an engine. Also, such devices typically include a three-way valve, which may be slow in actuating a valve deactivator.

Accordingly, it is desirable to provide an improved valve deactivation system with reduced complexity and improved speed of operation.

SUMMARY OF THE INVENTION

The present invention provides an individual hydraulic circuit module for each engine cylinder having deactivation capability. These single cylinder modules have the advantage of simplifying the hydraulic circuit. They allow any cylinders to be deactivated, and the design allows sharing between different engine families because the individual hydraulic circuit module could be fit onto any engine. These modules also reduce the cost of service because a bad module can simply be removed for repair or replacement.

More specifically, the invention provides an internal combustion engine having hydraulically-controlled cylinder deactivation, including an engine block with an oil supply gallery and a plurality of cylinders formed therein. At least one-half of the cylinders are deactivatable by collapsible lifters. The engine block includes first and second lifter openings adjacent each deactivatable cylinder and includes the collapsible lifters in the lifter openings. First and second deactivator feed channels communicate the first and second lifter openings, respectively, with a top surface of the engine block. A supply channel communicates the top surface with the oil supply gallery. An individual hydraulic circuit module is connected to the top surface adjacent each deactivatable cylinder and includes a hydraulic plate with a flow channel formed therethrough in communication with the respective first and second deactivator feed channels and with the respective supply channel. The individual hydraulic circuit module also includes a solenoid valve for selectively blocking oil flow from the flow channel to an exit port of the module to selectively build oil pressure in the flow channel and in the lifter openings to actuate the collapsible lifters to enable cylinder deactivation.

Another aspect of the invention provides that each solenoid valve is a two-way, on/off valve which is operative to selectively discommunicate the flow channel from an exit port to cause oil pressure to build up in the flow channel to actuate the collapsible lifters.

Preferably, the flow channel in each hydraulic plate is configured to slope upwardly in a direction toward the respective solenoid valve to assist in purging air from the hydraulic circuit module.

Another aspect of the invention provides a solid cover plate covering the respective supply channels and deactivator feed channels adjacent those cylinders which are not deactivatable. Preferably, each hydraulic plate and cover plate is substantially the same size and has similarly situated attachment holes to facilitate interchangeability of hydraulic plates and cover plates.

Preferably, a flow control orifice is positioned between the supply channel and the flow channel to increase fluid flow velocity and reduce parasitic losses. The flow control orifice may be integral with a filter positioned in the supply channel.

Accordingly, an object of the present invention is to provide an improved hydraulically-controlled cylinder deactivation system which employs individual hydraulic cylinder modules for each deactivatable cylinder to provide hydraulic control of cylinder deactivation for such cylinders.

The above object and other objects, features, and advantages of the present invention are readily apparent from the following detailed description of the best modes for carrying out the invention when taken in connection with the accompanying drawings.

BRIEF DESCRIPTION OF THE DRAWINGS

FIG. 1 shows a perspective view of an engine block in which the present invention is incorporated;

FIG. 3 is a top plan view of an individual hydraulic circuit module connected to an engine block in accordance with the present invention;

FIG. 6 shows an enlarged cross-sectional view of the filter shown in FIG. 5;

FIG. 7 shows a cross-sectional view of the individual hydraulic circuit module and engine block, the section being orthogonal to that shown in FIG. 5.

DESCRIPTION OF THE PREFERRED EMBODIMENT

Figure 2:
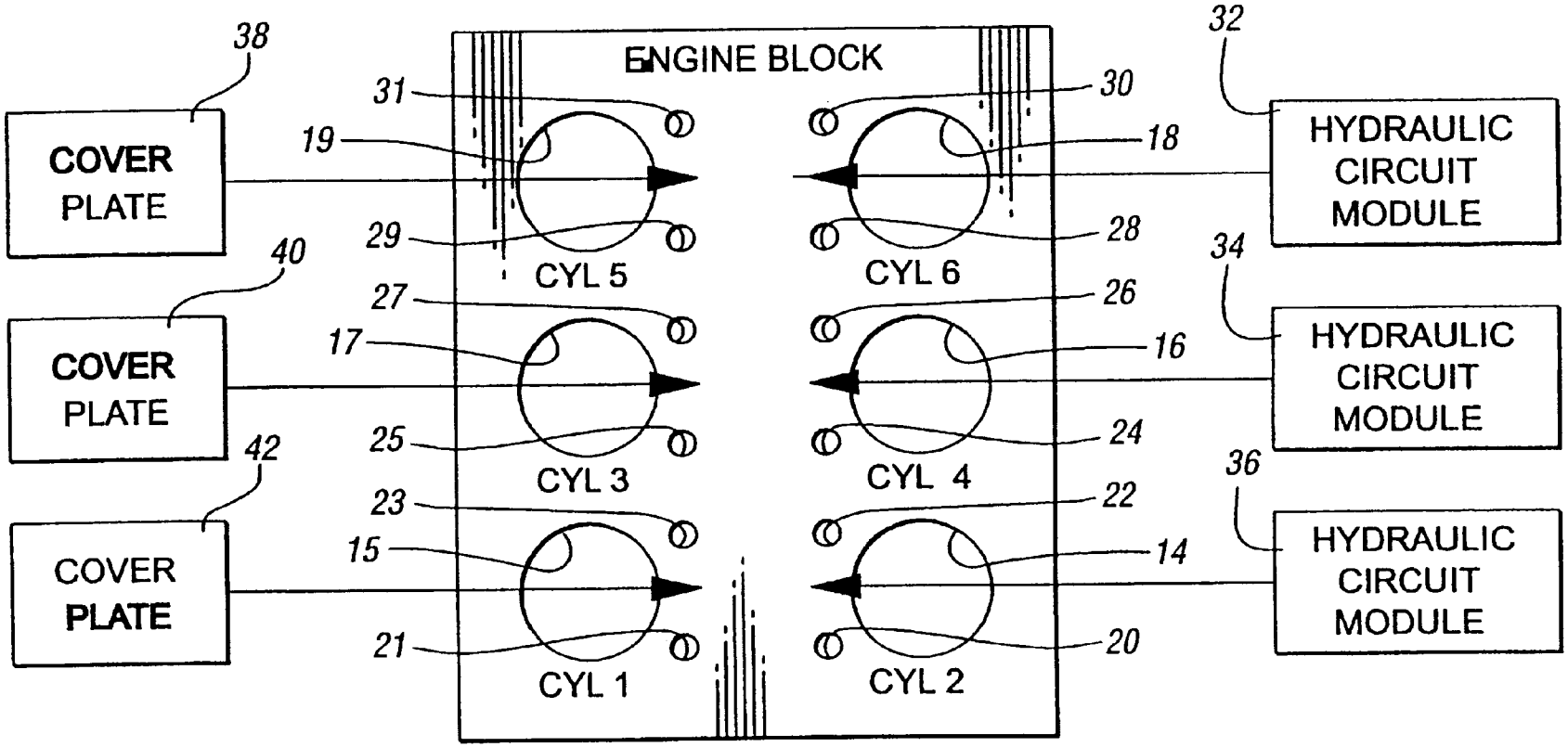
FIG. 2 is a schematic illustration of an engine block incorporating hydraulically-controlled cylinder deactivation in accordance with the present invention.

FIG. 1 shows an engine assembly 10 which includes an engine block 12 having a plurality of cylinders 14, 16, 18 therein. Adjacent each cylinder 14, 16, 18 are corresponding lifter openings 20, 22, 24, 26, 28, 30. In order to deactivate the cylinders 14, 16, 18 of the engine assembly 10, collapsible lifters (also known as deactivator assemblies) are inserted into the corresponding lifter openings 20, 22, 24, 26, 28, 30 to create lost motion, as described previously, to deactivate the corresponding intake and exhaust valves on the cylinders 14, 16, 18. By way of example, the collapsible lifters or deactivator assemblies inserted into the lifter openings may comprise the deactivator assembly described in U.S. Pat. No. 6,196,175, which is hereby incorporated by reference in its entirety. However, this invention would be useful for any hydraulically-actuated valve deactivation system.

In order to provide pressurized oil to such collapsible lifters within the lifter openings 20, 22, 24, 26, 28, 30, individual hydraulic circuit modules 32, 34, 36 would be provided adjacent each of the lifter openings 20, 22, 24, 26, 28, 30, as illustrated in FIG. 2, to control hydraulic fluid which is operative to actuate the collapsible lifters.

As further shown in FIG. 2, the cylinders 15, 17, 19 are not deactivated, so cover plates 38, 40, 42 are provided adjacent the respective lifter openings 21, 23, 25, 27, 29, 31. The cover plates allow the use of a common machined engine block. This provides the maximum number of cylinder combinations with minimum machining variability.

When cylinders are deactivated, deactivation is provided on alternating cylinders in the firing order. Accordingly, cover plates will be provided adjacent the active cylinders, and individual hydraulic circuit modules are provided adjacent the deactivatable cylinders.

A more detailed description of an individual circuit module 32 is provided below with reference to FIGS. 3–7, and a more detailed description of the function of the cover plate 38 is provided with reference to FIG. 8, by way of example.

Figure 4:
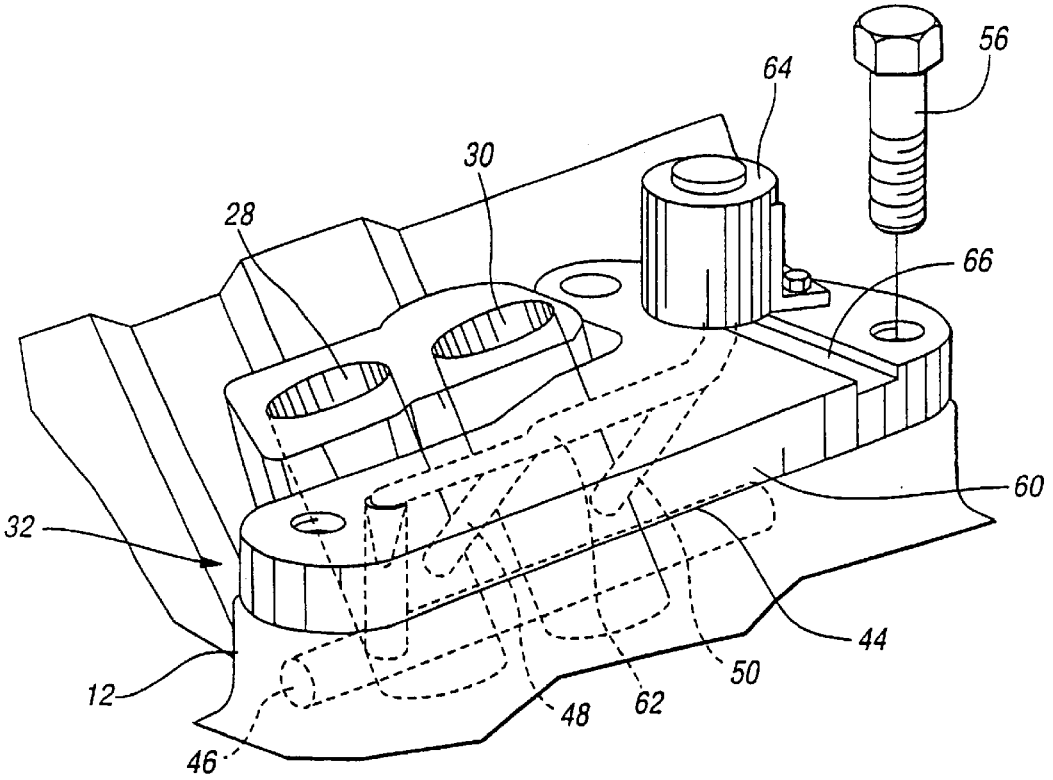
FIG. 4 is a perspective view of the individual hydraulic circuit module and engine block of FIG. 3.
Figure 5:
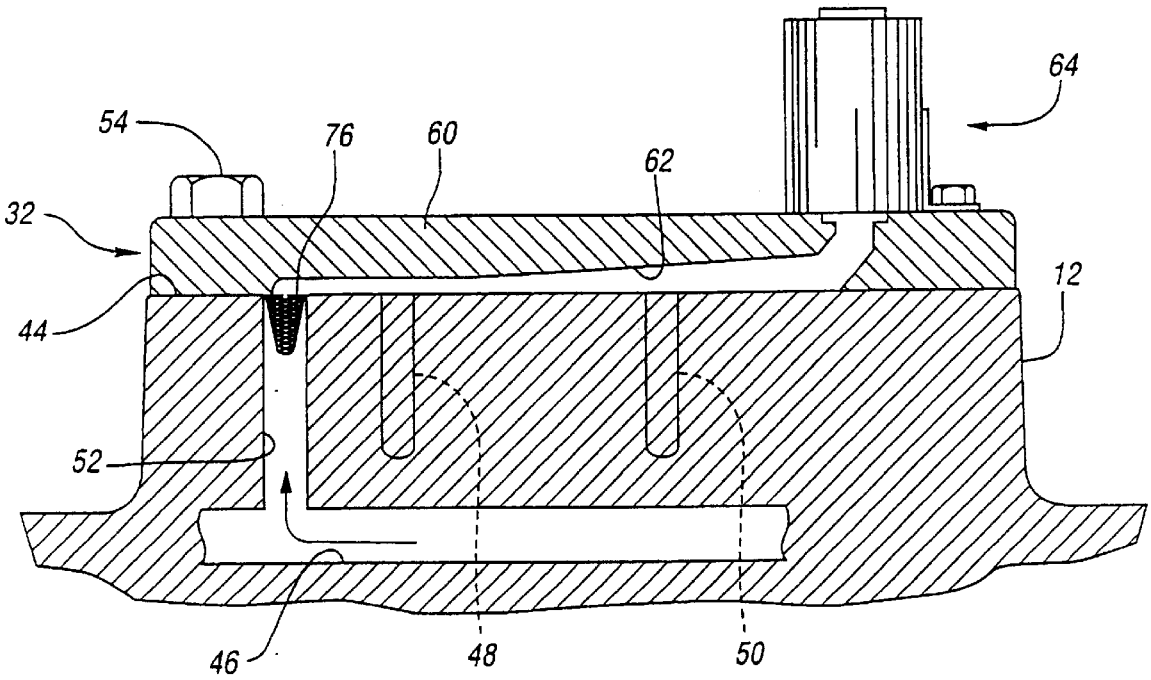
FIG. 5 shows a vertical cross-sectional view of the individual hydraulic circuit module and engine block of FIG. 3.

FIGS. 3–5 illustrate the individual hydraulic circuit module 32 attached to a top surface 44 of an engine block 12 closely adjacent the lifter openings 28, 30. As shown, the engine block 12 includes an oil supply gallery 46 which carries a pressurized supply of oil. The engine block 12 also includes first and second deactivator feed channels 48, 50 which communicate the first and second lifter openings 28, 30, respectively, with the top surface 44 of the engine block 12. A supply channel 52 communicates the top surface 44 with the oil supply gallery 46.

The individual hydraulic circuit module 32 is connected to the top surface 44 adjacent the lifter openings 28, 30 by the bolts 54, 56 which extend through the hydraulic plate 60.

The hydraulic plate 60 includes a ramped flow channel 62 formed therethrough and positioned for fluid communication with the first and second deactivator feed channels 48, 50 and with the supply channel 52. The individual hydraulic circuit module 32 also includes a solenoid valve 64 for selectively blocking oil flow from the flow channel 62 to the exit port 66 to selectively build oil pressure in the flow channel 62, in the first and second deactivator feed channels 48, 50, and in the lifter openings 28, 30 to actuate the collapsible lifters 68 to enable cylinder deactivation.

The solenoid valve 64 is preferably a two-way, solenoid-controlled on/off valve. As described above, the solenoid valve 64 selectively blocks flow to the exit port 66 so that pressure may build up in the flow channel 62, which causes pressure build-up in the first and second deactivator feed channels 48, 50 and also in the lifter openings 28, 30, thereby actuating the collapsible lifter 68, which is shown in phantom in FIG. 7. As described previously, the collapsible lifter 68 may comprise any hydraulically-actuated deactivator device, such as that described in the '175 patent. The collapsible lifter 68 includes a follower 70 which engages the cam surface 72 on the rotating camshaft 74.

As most clearly shown in FIG. 5, the flow channel 62 in each hydraulic plate 60 is configured to slope upwardly in a direction toward the respective solenoid valve 64 to assist in purging air from the hydraulic circuit module 32.

As further shown in FIG. 5, a filter 76 is provided in the supply channel 52 for filtering the oil. As shown in FIG. 6, the filter 76 may include a control orifice 78 which is formed in the upper plate 79 of the filter 76. Alternatively, the control orifice may be formed by a narrow section in the flow channel 62. The control orifice 78 increases fluid flow velocity and reduces parasitic losses.

The individual hydraulic circuit module 32 described above is exemplary of each of the hydraulic control modules 32, 34, 36 represented in FIG. 2.

Figure 8:
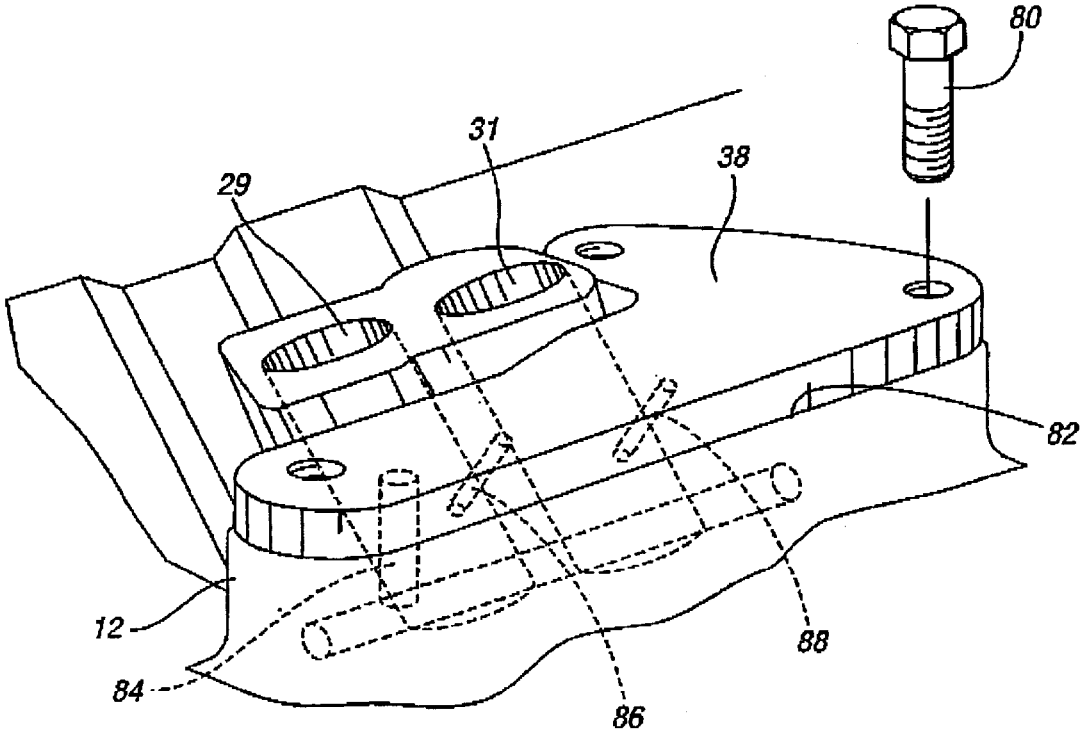
FIG. 8 shows a perspective view of a cover plate and engine block in accordance with the present invention.

FIG. 8 illustrates a cover plate 38 which is exemplary of each cover plate 38, 40, 42 represented in FIG. 2. As shown, the cover plate 38 is bolted into position, such as by bolts 80, on the top surface 82 of the engine block 12 adjacent the lifter openings 29, 31. The cover plate 38 is simply a solid plate which is positioned flush against the top surface 82 to block the supply channel 84 and the first and second deactivator feed channels 86, 88 because valve deactivation is not required in the corresponding cylinder 19. Preferably, the cover plate 38 is substantially the same size as the hydraulic plate 60 described above with reference to FIGS. 3–7, and includes similarly situated attachment holes to facilitate interchangeability of hydraulic plates and cover plates. Accordingly, adjacent those cylinders not having cylinder deactivation, a cover plate 38 would be applied, and individual hydraulic circuit modules 32 would be attached adjacent those cylinders having cylinder deactivation.

Additional components can also be used to increase the robustness of the design. For example, a gasket can be used for additional sealing between the cover plate or hydraulic plate and the engine block.

While the best mode for carrying out the invention has been described in detail, those familiar with the art to which this invention relates will recognize various alternative designs and embodiments for practicing the invention with the scope of the appended of the appended claims.

What is claimed is:

1. An internal combustion engine having hydraulically-controlled cylinder deactivation, the engine comprising:

an engine block having an oil supply gallery and a plurality of cylinders formed therein, at least one half of said cylinders being deactivatable by collapsible lifters;

said engine block including first and second lifter openings adjacent each deactivatable cylinder, and having said collapsible lifters therein;

first and second deactivator feed channels communicating the first and second lifter openings, respectively, with a top surface of the engine block, and a supply channel communicating the top surface with the oil supply gallery; and an individual hydraulic circuit module connected to the top surface adjacent each deactivatable cylinder and including a hydraulic plate with a flow channel formed therethrough and positioned in fluid communication with the respective first and second deactivator feed channels and with the respective supply channel, said module also including a solenoid valve for selectively blocking oil flow from the flow channel to an exit port of the module to selectively build oil pressure in the flow channel and in the lifter openings to actuate the respective collapsible lifters to enable cylinder deactivation.

2. The internal combustion engine of claim 1, wherein the flow channel in each hydraulic plate is configured to slope upwardly in a direction toward the respective solenoid valve to assist in purging air from the hydraulic circuit module.

3. The internal combustion engine of claim 2, wherein each of said cylinders which is not deactivatable includes a solid cover plate covering the respective supply channels and deactivator feed channels.

4. The internal combustion engine of claim 3, wherein each said hydraulic plate and cover plate is substantially the same size and has similarly situated attachment holes to facilitate interchangeability of hydraulic plates and cover plates.

5. The internal combustion engine of claim 1, further comprising a flow control orifice between the supply channel and the flow channel to increase fluid flow velocity and reduce parasitic losses.

6. The internal combustion engine of claim 5, wherein said flow control orifice is integral with a filter positioned in the supply channel.

7. The internal combustion engine of claim 1, wherein each said lifter opening is adjacent a rotating cam for operating the respective collapsible lifter.

8. An internal combustion engine having hydraulically-controlled cylinder deactivation, the engine comprising:

an engine block having a plurality of cylinders formed therein with an oil supply channel adjacent each cylinder, at least one half of said cylinders being deactivatable by collapsible lifters;

an individual hydraulic circuit module positioned adjacent each deactivatable cylinder, each said hydraulic circuit module including a valve and configured to receive a supply of oil from the oil supply channel and to selectively provide pressurized oil to the respective collapsible lifters for cylinder deactivation; and a solid cover plate positioned adjacent each cylinder which is not deactivatable to cover the respective oil supply channels.

9. The internal combustion engine of claim 8, wherein each hydraulic circuit module is interchangeable with each said cover plate.

10. The internal combustion engine of claim 8, wherein each hydraulic circuit module includes a flow channel therein which communicates oil supplied from the engine block to the respective collapsible lifters, and wherein oil pressure is selectively built up in the flow channel to actuate the collapsible lifters by closing the respective valve.

11. An internal combustion engine having hydraulically-controlled cylinder deactivation, the engine comprising:

an engine block having a plurality of cylinders formed therein, at least one half of said cylinders being deactivatable by collapsible lifters;

an individual hydraulic circuit module positioned adjacent each deactivatable cylinder, each said hydraulic circuit module including a hydraulic plate with a flow channel formed therein to receive a supply of oil from the engine block and to communicate the supply of oil with an exhaust port and with the respective collapsible lifters;

wherein each said hydraulic circuit module includes a two-way, solenoid-controlled on/off valve which is operative to selectively discommunicate the flow channel from the exit port to cause oil pressure build-up in the flow channel to actuate the respective collapsible lifters.

12. The internal combustion engine of claim 11, further comprising a solid cover plate positioned adjacent each cylinder which is not deactivatable.

13. The internal combustion engine of claim 12, wherein each hydraulic circuit module is interchangeable with each said cover plate.

* * * * *